US007490789B2

(12) United States Patent
Omi

(10) Patent No.: US 7,490,789 B2
(45) Date of Patent: Feb. 17, 2009

(54) SHREDDER WITH PAPER FEEDER AND A PAPER FEEDER

(75) Inventor: Kazuyoshi Omi, Saitama pref. (JP)

(73) Assignee: KTF Corporation, Tokyo (JP)

( * ) Notice: Subject to any disclaimer, the term of this patent is extended or adjusted under 35 U.S.C. 154(b) by 95 days.

(21) Appl. No.: 11/534,820

(22) Filed: Sep. 25, 2006

(65) Prior Publication Data

US 2007/0176033 A1 Aug. 2, 2007

(30) Foreign Application Priority Data

Feb. 1, 2006 (JP) ..... 2006-024484

(51) Int. Cl.
*B02C 18/22* (2006.01)

(52) U.S. Cl. ..... 241/225; 241/236; 271/125

(58) Field of Classification Search ..... 241/223–225, 241/236, 100; 271/119, 125
See application file for complete search history.

(56) References Cited

U.S. PATENT DOCUMENTS 4,817,877 A * 4/1989 Itoh et al. ..... 241/34
4,986,481 A * 1/1991 Fujii et al. ..... 241/30
5,772,129 A * 6/1998 Nishio et al. ..... 241/30

FOREIGN PATENT DOCUMENTS

JP 2005-46827 2/2005

* cited by examiner

*Primary Examiner*—Mark Rosenbaum
(74) *Attorney, Agent, or Firm*—K&L Gates LLP

(57) ABSTRACT

A shredder equipped with paper feeder comprises a shredder unit including a pair of intermeshed cutting cylinders driven by a power source and a paper feeder, which paper feeder has a cover, a paper feeding tray on which paper sheets are set and held, a lifter unit pivotally mounted on a base of the paper feeding tray to be vertically movable, a first feed roller for feeding out multiple paper sheets from the paper feeding tray, a separator wall for controlling the number of paper sheets fed to approximately the number the shredder can shred at one time, a second feed roller for feeding forward the paper sheets passed by the separator wall, a control unit for feeding from the second feed roller a number of paper sheets not greater than the number the shredder can shred at one time, a third feed roller and fourth feed roller for nipping and transporting to the shredder the paper sheets exiting the control unit, and a control switch for controlling the operation of the first feed roller and second feed roller. The shredder with paper feeder enables a stack of document sheets to be automatically fed into the shredder and shredded in lots of a specified maximum number of sheets simply by setting the stack in the paper feeder.

6 Claims, 2 Drawing Sheets

SHREDDER WITH PAPER FEEDER AND A PAPER FEEDER

BACKGROUND OF THE INVENTION

1. Field of the Invention

The present invention relates to a shredder for shredding paper sheets, particularly to a shredder with paper feeder capable of automatically feeding and shredding multiple paper sheets, and to a paper feeder.

2. Description of Related Art

In order to prevent information theft, the practice in recent years is not to simply discard documents as they are but to dispose of them after cutting them into fine pieces with a shredder or other such cutting apparatus. Although the performance of shredders has improved considerably and many are now capable of fine shredding, a problem remains in that the number of sheets that can be shredded at one time is limited. Shredders marketed to date require the user to manually insert a single sheet or up to a manufacturer-specified maximum number of sheets into the shredder slot, so that the user must stay at the shredder throughout the shredding operation, which may be quite long when shredding a large number of sheets.

A need has therefore been felt for the development of a shredder with paper feeder, i.e., a shredder equipped with a dedicated paper feeder that can automatically shred a large number of document sheets, and of a paper feeder for use with the shredder.

A typical example of the shredder according to the prior art is described in Japanese Unexamined Patent Publication No. 2005-46827.

SUMMARY OF THE INVENTION

An object of the present invention is to overcome the aforesaid problems by providing a shredder with paper feeder and a paper feeder that enable a stack of document sheets to be automatically fed into the shredder and shredded in lots of a specified maximum number of sheets simply by setting the stack in the paper feeder.

The present invention achieves the foregoing object by providing a shredder equipped with paper feeder comprising a shredder unit including a pair of intermeshed cutting cylinders driven by a power source and a paper feeder, which paper feeder has a cover, a paper feeding tray on which paper sheets are set and held, a lifter unit pivotally mounted on a base of the paper feeding tray to be vertically movable, a first feed roller for feeding out multiple paper sheets from the paper feeding tray, a separator wall for controlling the number of paper sheets fed to approximately the number the shredder can shred at one time, a second feed roller for feeding forward the paper sheets passed by the separator wall, a control unit for feeding from the second feed roller a number of paper sheets not greater than the number the shredder can shred at one time, a third feed roller and fourth feed roller for nipping and transporting to the shredder the paper sheets exiting the control unit, and a control switch for controlling the operation of the first feed roller and second feed roller.

Driving power is transmitted to the first feed roller, second feed roller, third feed roller and fourth feed roller through gears fitted thereon and a gear of the fourth feed roller is engaged with a power transmission gear fitted on one cutting cylinder of the shredder to be driven by power transmitted from the shredder.

The paper feeder for mechanically inserting a stack of paper sheets into the shredder is detachably installed on the shredder for holding the stack and automatically sending it to the shredder.

The present invention also provides a paper feeder comprising a cover, a paper feeding tray on which paper sheets are set and held, a lifter unit pivotally mounted on a base of the paper feeding tray to be vertically movable, a first feed roller for feeding out multiple paper sheets from the paper feeding tray, a separator wall for controlling the number of paper sheets fed to approximately the number a shredder can shred at one time, a second feed roller for feeding forward the paper sheets passed by the separator wall, a control unit for feeding from the second feed roller a number of paper sheets not greater than the number the shredder can shred at one time, a third feed roller and fourth feed roller for nipping and feeding to the shredder the paper sheets exiting the control unit, a control switch for controlling the operation of the first feed roller and second feed roller, an electrically operated power source for supplying driving power, and gears fitted on the first feed roller, second feed roller, third feed roller and fourth feed roller for operating them by power from the power source.

The cover is provided with an insertion slot for directly loading into the shredder a number of paper sheets between one and not greater than the number the shredder can shred at one time.

As will be understood from in the foregoing, the shredder with paper feeder and the paper feeder according to the present invention offer the following advantageous features:

1. Paper sheets can be automatically shredded while controlling the number thereof loaded into the shredder to not greater than a specified maximum number of sheets that can be shredded at one time.
2. Owing to the fact that gears of the paper feeder are driven by a gear on one of the shredder cutting cylinders, the shredding speed and paper feed speed can be readily synchronized
3. The paper feeder can be supplied as an independent unit that can be mounted on and operated in conjunction with any of various conventional shredders long available on the market.
4. The paper feeder can be equipped with and operated by its own power source so as to be capable of operating when installed on any kind of shredder.
5. The insertion slot provided for convenience when shredding a small number of paper sheets enables the user to load paper sheets directly into the shredder.

DESCRIPTION OF THE PREFERRED EMBODIMENT

Figure 1:
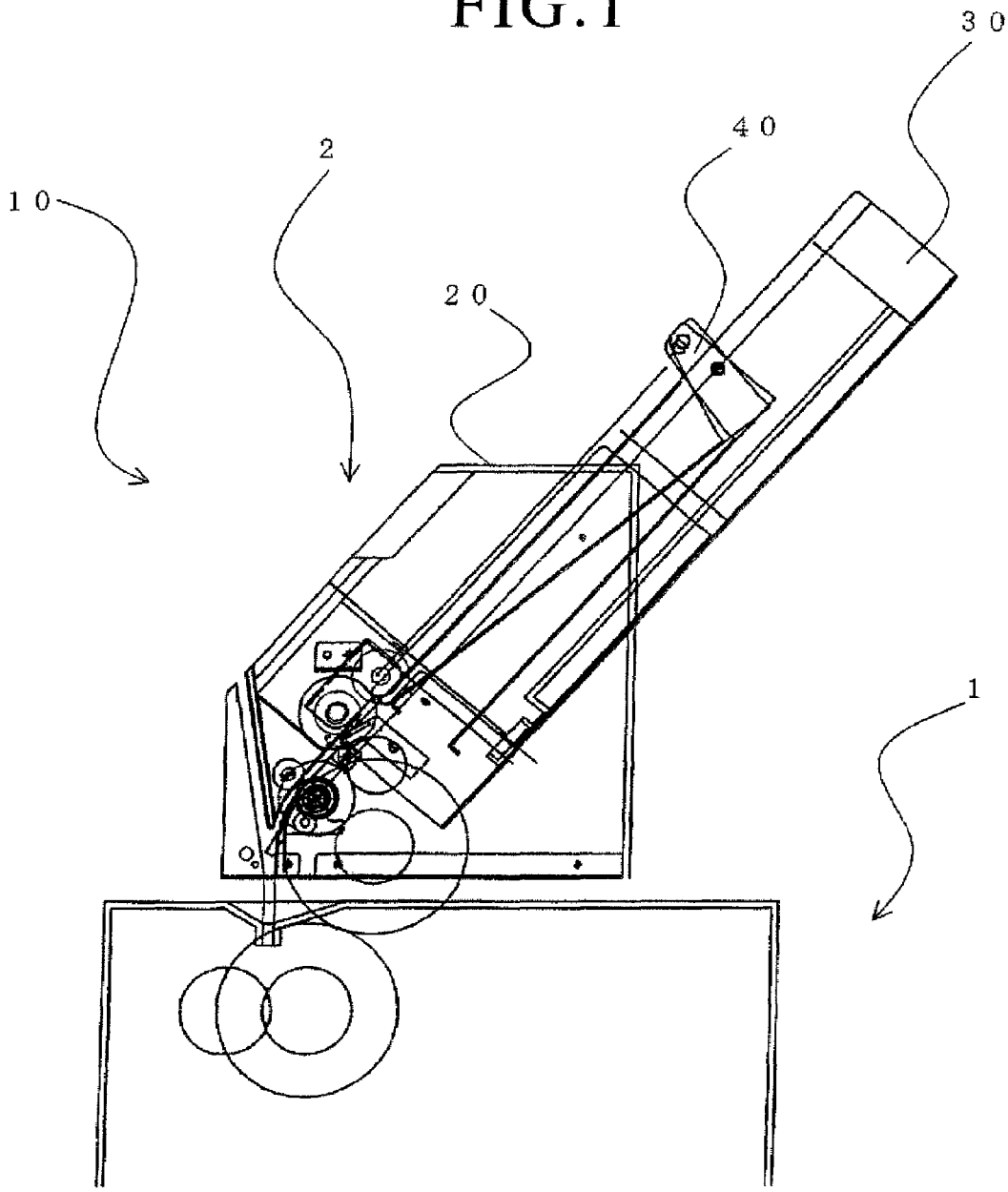
FIG. 1 is a side sectional view of the shredder with paper feeder of the present invention.

The shredder with paper feeder and paper feeder according to the present invention will now be explained with reference to an embodiment shown in the drawing.

Figure 2:
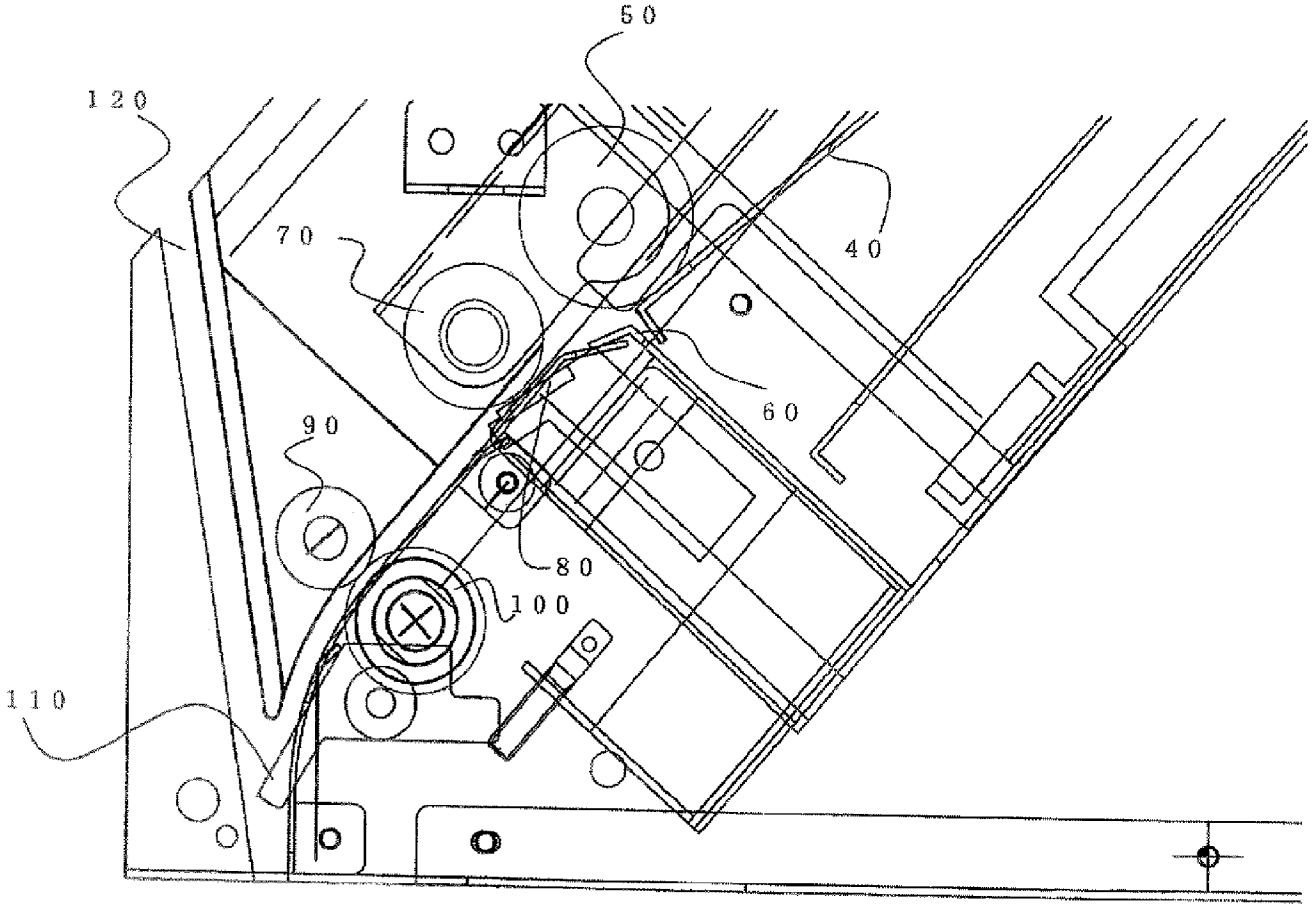
FIG. 2 is an enlarged side sectional view of the shredder with paper feeder of the present invention.

As shown in FIGS. 1 and 2, the shredder with paper feeder, designated 10, comprises a shredder unit 1 and a paper feeder 2.

The shredder unit 1 is structurally similar to preexisting commercially available shredders. It is equipped with a power source (not shown) that transmits rotational driving power to a pair of cutting cylinders through gears. In this embodiment, a gear associated with one of the cutting cylinders engages a gear of the paper feeder and supplies power thereto.

The paper feeder 2 comprises a main unit cover 20, paper feeding tray 30, lifter unit 40, first feed roller 50, separator wall 60, second feed roller 70, control unit 80, third feed roller 90, fourth feed roller 100, and control switch 110.

The main unit cover 20 covers the paper feeder 2 and can be made of any of various materials. The main unit cover 20 is formed with an insertion slot 120 that preferably has a width about the same as or slightly narrower than the shredder slot.

The paper feeding tray 30 is for holding paper sheets to be sent into the shredder and shredded. The lifter unit 40 has a pivoted structure that allows it to rotate. The size of the paper feeding tray 30 is not particularly limited and can be changed to match the size of the paper sheets that the associated shredder is capable of shredding. The lifter unit 40 is structured to facilitate forwarding of a stack of paper sheets set in the paper feeding tray 30 to the first feed roller 50. Specifically, the lifter unit 40 comprises a lower elastic body that can be tilted upward and is supported by pivots that can optionally be provided with elastic members for biasing the lifter unit upward.

As shown in the drawings, the paper feeding tray 30 and lifter unit 40 are installed at an incline so that the paper sheets readily advance toward the first feed roller 50 under their own weight. But the present invention is not limited to the inclined installation of this embodiment and it is alternatively possible to install the paper feeding tray 30 horizontally. In such case, however, forwarding of the paper sheets may become impossible unless the tractive force that the lifter unit 40 applies to them is strong. The inclined orientation of the paper feeding tray 30 is therefore preferable.

The first feed roller 50 is for nipping and transporting the sheets held in the paper feeding tray 30 in order to send stacks thereof to the shredder. It is disposed to make contact with the leading end of the sheet stack and is driven by a gear (not shown).

The separator wail 60 is an abutment wall for limiting the number of stacked papers sheets sent from the first feed roller 50 to the shredder to approximately the number the shredder is rated to be capable of shredding at one time. When the number of sheets forwarded by the first feed roller 50 is considerably larger than the rated number (shreddable number), the number in excess is stopped by the separator wall 60 and not sent onward.

The second feed roller 70 operates to further forward the sheet stack fed out by the first feed roller 50. The control unit 80 is installed under the second feed roller 70 and the gap between the second feed roller 70 and control unit 80 is set approximately to a width capable of passing a number of sheets equal to or smaller than the number the shredder is capable of cutting at one time. In other words, the number of sheets loaded into the shredder is controlled in two stages, first by the first feed roller 50 and separator wall 60 and next by the second feed roller 70 and control unit 80, so as not to exceed the number of sheets that the particular shredder concerned is capable of shredding at one time.

The third feed roller 90 and fourth feed roller 100 operate to nip the sheet stack exiting from between the second feed roller 70 and control unit 80 and forward it to the shredder unit. The fourth feed roller 100 can optionally be equipped with a gear for ensuring reliable transmission of power.

The control switch 110 operates in response to nipping and forwarding of a sheet stack by the third feed roller 90 and fourth feed roller 100 to control the rotation of the first feed roller and second feed roller. The control switch is configured to be depressed and turned ON during passage of a sheet stack. This arrangement provides control for preventing paper jamming that might otherwise occur in the paper feeder if all rollers should be maintained in operation to constantly forward paper stacks to the shredder. In addition, although not shown in the drawings, the control is implemented by means of an electromagnetic clutch in this embodiment. However, the invention is not limited to use of an electromagnetic clutch and any of various other control means are also utilizable.

Moreover, the control switch 110 can be functionally incorporated in the form of any of various types of sensors.

Although not illustrated in the drawings, in this embodiment each of the rollers is fitted with a gear and the rollers are rotated by rotating the gears. Further, the gear of the fourth feed roller is engaged with a gear of a cutting cylinder of the shredder unit, thereby making it unnecessary to equip the paper feeder with a power source. This is advantageous in that it lowers cost and makes it easy to synchronize the paper feeder rollers with the cutting cylinders of the shredder unit.

The operation of the shredder with paper feeder of the present invention will now be explained in detail. The operation begins with the user setting a stack of paper sheets to be shredded on the lifter unit 40 of the paper feeding tray 30. The lower end of stacked sheets placed in the paper feeding tray 30 makes contact with the first feed roller 50, which feeds forward a number of the sheets from the top of the stack. Owing to the inclination of the paper feeding tray 30, the sheet stack comes into contact with the first feed roller under its own weight without fail and a number thereof is therefore transported forward under its own weight so long as the first feed roller is rotating.

The user puts the shredder with paper feeder in operation by pressing a start switch (not shown) provided on the shredder unit or the paper feeder. The separator wall permits passage of only a limited number of the document sheets in the stack sent thereto by the first feed roller. Although a paper feeder used with a printer or the like is designed to feed only a single sheet of paper at a time, the purpose of the paper feeder of the present invention is to feed a number of sheets simultaneously. The height of the separator wall is therefore set somewhat low so as to send toward the shredder a stack of sheets of approximately the number that the shredder can shred at one time.

After passing the first feed roller and separator wall, the sheet stack passes through the gap between the second feed roller and control unit to be further controlled to a number of sheets equal to or smaller than the number the shredder is capable of shredding at one time. The sheet stack forwarded by the second feed roller is nipped and transported by the third feed roller and fourth feed roller. When the sheet stack reaches the control switch and makes contact therewith, the control switch operates to stop the rotation of the first feed roller and second feed roller. This is a measure for preventing paper jamming which might be caused by continuous feeding of sheet stacks. Forwarding of the sheet stack to the shredder unit proceeds even after the second feed roller is stopped because it continues to be nipped and transported by the third feed roller and fourth feed roller.

In this embodiment, forwarding of the sheet stack to the shredder unit is initiated by turning on the start switch (not shown). However, it is instead possible to adopt a configuration like that in many shredders commercially available heretofore which rotates the cutting cylinders to start shredding in response to sensor detection.

In addition, it is possible to equip the paper feeder according to the present invention with a power source so as to provide an independent unit that can be mounted on and operated in association with a preexisting shredder. In this case, smooth, jam-free paper feeding can be ensured by establishing a rotational speed ratio of $V>V_4=V_3>V_2>V_1$, where V is the rotational speed of the cutting cylinder, $V_1$ is the rotational speed of the first feed roller, $V_2$ is the rotational speed of the second feed roller, $V_3$ is the rotational speed of the third feed roller, and $V_4$ is the rotational speed of the fourth feed roller.

In the case where the rotational speed of the cutting cylinders of the preexisting shredder is high, this can be coped with by incorporating a one-way clutch for speed regulation into the third feed roller.

The insertion slot 120 is provided in the main unit cover 20 of the paper feeder 2 so that when only a small number of document sheets are to be shredded, the user can insert them directly into the shredder unit.

Conventional shredders commercially available heretofore require manual insertion of paper sheets so that user must remain at the shredder until the job is finished. In contrast, the shredder with paper feeder and the paper feeder of the present invention make it possible to shred stacks of paper sheets automatically. Although an adaptor must be additionally installed before the paper feeder can be mounted on a preexisting shredder, no such adapter is required for attaching the paper feeder of the present invention to a shredder designed for use therewith. It is further possible to provide a sensor on the lifter unit 40 of the paper feeding tray 30 and automatically turn off the shredder with paper feeder when the sensor detects that the paper feeding tray is empty.

What is claimed is:

1. A shredder equipped with a paper feeder, the shredder comprising:

a shredder unit including a pair of intermeshed cutting cylinders driven by a power source and a paper feeder, the paper feeder comprising:

a cover;

a paper feeding tray on which paper sheets can be accommodated and held;

a first feed roller for feeding a batch of multiple paper sheets from the paper feeding tray;

a separator wall for controlling the number of paper sheets in the batch of paper sheets fed from the paper feeding tray to be a plural number of sheets not greater than the number the shredder can shred at one time;

a second feed roller for feeding forward the batch of paper sheets passed by the separator wall;

a control unit installed under the second roller for controlling the gap between the second feed roller and the control unit to feed the batch of paper sheets from the second feed roller with a plural number of paper sheets in the batch not greater than the number the shredder can shred at one time;

a third feed roller and a fourth feed roller for conjointly nipping and transporting to the shredder the batch of paper sheets exiting the control unit; and a control switch for controlling the operation of the first feed roller and the second feed roller.

2. The shredder equipped with a paper feeder according to claim 1, wherein driving power is transmitted to the first feed roller, the second feed roller, the third feed roller and the fourth feed roller through driven gears fitted to the respective rollers and wherein the driven gear of the fourth feed roller is engaged with a power transmission gear fitted on a cutting cylinder of the shredder to be driven by power transmitted from the shredder.

3. A shredder equipped with a paper feeder according to claim 2, wherein the cover is provided with an insertion slot for directly loading into the shredder a plural number of paper sheets not greater than the number the shredder can shred at one time.

4. A shredder equipped with a paper feeder according to claim 1, wherein the paper feeding tray has an inclined disposition to advance the paper sheets to the first roller under gravity and wherein the paper feeder comprises a lifter unit pivotally mounted on the paper feeding tray and upwardly biased to facilitate gravity feeding of the paper sheets from the paper feeding tray to the first roller unit.

5. A paper feeder for feeding paper to a shredder, the paper feeder comprising:

a cover; a paper feeding tray on which paper sheets can be accommodated and held;

a first feed roller for feeding a batch of multiple paper sheets from the paper feeding tray;

a separator wall for controlling the number of paper sheets in the batch of paper sheets fed from the paper feeding tray to be a plural number of sheets not greater than the number the shredder can shred at one time;

a second feed roller for feeding forward the batch of paper sheets passed by the separator wall;

a control unit installed under the second roller for controlling the gap between the second feed roller and the control unit to feed the batch of paper sheets from the second feed roller with a plural number of paper sheets in the batch not greater than the number the shredder can shred at one time;

a third feed roller and fourth feed roller for conjointly nipping and feeding to the shredder the batch of paper sheets exiting the control unit;

a control switch for controlling the operation of the first feed roller and the second feed roller;

an electrically operated power source for supplying driving power; and gears fitted on the first feed roller, the second feed roller, the third feed roller and the fourth feed roller for operating the rollers with power from the power source.

6. A paper feeder according to claim 5, wherein the paper feeding tray has an inclined disposition to advance the paper sheets to the first roller under gravity and wherein the paper feeder comprises a lifter unit pivotally mounted on the paper feeding tray and upwardly biased to facilitate gravity feeding of the paper sheets from the paper feeding tray to the first roller unit.

* * * * *